US005339738A

United States Patent [19]

Blaser et al.

[11] Patent Number: 5,339,738

[45] Date of Patent: Aug. 23, 1994

[54] SHEET-FED OFFSET PRINTING MACHINE EQUIPPED FOR AUTOMATED CHANGING OF PRINTING PLATES

[75] Inventors: Peter T. Blaser, Dielheim; Karl-Hermann Miltner, Dossenheim; Nikolaus Spiegel, Walldorf, all of Fed. Rep. of Germany

[73] Assignee: Heidelberger Druckmaschinen AG, Heidelberg, Fed. Rep. of Germany

[21] Appl. No.: 89,665

[22] Filed: Jul. 9, 1993

[30] Foreign Application Priority Data

Jul. 9, 1992 [DE] Fed. Rep. of Germany ..... 4222503
Aug. 21, 1992 [DE] Fed. Rep. of Germany ..... 4227683

[51] Int. Cl.[5] ..... B41F 27/00
[52] U.S. Cl. ..... 101/477; 101/415.1
[58] Field of Search ..... 101/477, 415.1, 378, 101/DIG. 36, 409, 410, 411, 232, 217

[56] References Cited

U.S. PATENT DOCUMENTS 5,094,165 3/1992 Sugiyama et al. ..... 101/415.1
5,127,328 7/1992 Wieland ..... 101/415.1
5,167,186 12/1992 Honkawa et al. ..... 191/217
5,181,466 1/1993 Ono ..... 101/477

FOREIGN PATENT DOCUMENTS 0318959 6/1989 European Pat. Off. ..... 101/477
0411731 2/1991 European Pat. Off. .
4128994 7/1992 Fed. Rep. of Germany .
62-169646 7/1987 Japan .
62-169647 7/1987 Japan .
63-191636 8/1988 Japan .

*Primary Examiner*—Eugene H. Eickholt
*Attorney, Agent, or Firm*—Herbert L. Lerner; Laurence A. Greenberg

[57] ABSTRACT

Sheet-fed offset printing machine for automated changing of a printing plate having a plate cylinder for carrying a printing plate, the plate cylinder being formed with a gap extending in axial direction thereof, a blanket cylinder formed with a gap extending in axial direction thereof disposed in cooperative engagement with the plate cylinder, and a clamping device disposed in the plate-cylinder gap and including a pair of movably disposed clamping rails defining therebetween a clamping slot located within the cross-sectional contour of the blanket cylinder, includes an insertion device for inserting, into the clamping slot defined by the clamping rails, a bent edge of a printing plate disposed on the plate cylinder, the bent edge being located at a trailing end of the printing plate, the insertion device being disposed in the gap formed in the blanket cylinder and having a thrust body formed with a thrust surface movable radially out of the cross-sectional contour of the blanket cylinder against the trailing end of the printing plate on the plate cylinder.

18 Claims, 4 Drawing Sheets

SHEET-FED OFFSET PRINTING MACHINE EQUIPPED FOR AUTOMATED CHANGING OF PRINTING PLATES

The invention relates to a sheet-fed offset printing machine for automated changing of a printing plate and, more particularly, to such a printing machine having a plate cylinder for carrying a printing plate, the plate cylinder being formed with a gap extending in axial direction thereof, a blanket cylinder formed with a gap extending in axial direction thereof disposed in cooperative engagement with the plate cylinder, a clamping device disposed in the plate-cylinder gap and including a pair of movably disposed clamping rails defining therebetween a clamping slot located within the cross-sectional contour of the blanket cylinder, and an insertion device for inserting a bent edge of a printing plate, located at a trailing end of the printing plate, into the clamping slot defined by the clamping rails.

Machines of this type have been disclosed heretofore in the published European Patent Document 0 411 731-A2- and also in the published Japanese Patent Document Sho 63-191636. According to the state of the prior art represented thereby, the insertion device is formed as an independent unit located outside of the plate cylinder and the impression cylinder and having a radially elastic roller capable of being brought into engagement with the plate cylinder. Following the clamping of the leading or front edge of the printing plate, the roller is brought into contact therewith so that it presses against the printing plate during the rotation of the plate cylinder and, at the end of the printing plate, inserts the bent edge of the printing plate into the clamping slot which lies within the cross-sectional contour of the plate cylinder. During the insertion, the circumference of the elastic roller partially enters the cross-sectional contour of the plate cylinder in order to press the bent edge of the trailing or rear end of the printing plate so deeply into the clamping slot between both clamping jaws of the clamping device within the cross-sectional contour of the plate cylinder that the peripheral trailing or rear edge of the printing plate is also located within the cross-sectional contour of the plate cylinder. Such accessories for inserting the angularly bent trailing or rear edge of the printing plate into a clamping slot of a clamping device must be equipped with safety devices in order to prevent collisions between moving parts. They are, consequently, quite expensive.

Heretofore known from the published German Patent Document 41 28 994 -C2-, is a special construction of a clamping device formed with a clamping slot for a bent edge of a trailing or rear end of a printing plate for a printing machine of the foregoing general type.

It is an object of the invention to provide a sheet-fed offset printing machine equipped for effecting automated changing of a printing plate, wherein the insertion of a bent edge of a printing plate at a trailing or rear end of the printing plate is accomplished while avoiding any necessity for an additional device and by employing low-cost, operationally reliable means located on a blanket cylinder and acting independently of the construction of the clamping device.

With the foregoing and other objects in view, there is provided, in accordance with the invention, a sheet-fed offset printing machine for automated changing of a printing plate having a plate cylinder for carrying a printing plate, the plate cylinder being formed with a gap extending in axial direction thereof, a blanket cylinder formed with a gap extending in axial direction thereof disposed in cooperative engagement with the plate cylinder, and a clamping device disposed in the plate-cylinder gap and including a pair of movably disposed clamping rails defining therebetween a clamping slot located within the cross-sectional contour of the blanket cylinder, and comprising an insertion device for inserting, into the clamping slot defined by the clamping rails, a bent edge of a printing plate disposed on the plate cylinder, the bent edge being located at a trailing end of the printing plate, the insertion device being disposed in the gap formed in the blanket cylinder and having a thrust body formed with a thrust surface movable radially out of the cross-sectional contour of the blanket cylinder against the trailing end of the printing plate on the plate cylinder.

This construction is based upon the conception that, in order to insert the bent edge at the trailing or rear end of the plate cylinder into the clamping slot of the clamping device disposed in the gap formed in the plate cylinder, an insertion device is disposed recessed in the gap formed in the blanket cylinder, and a thrust body of the insertion device is moved radially out of the cross-sectional contour of the blanket cylinder so that it enters the cross-sectional contour of the plate cylinder and inserts the bent edge of the plate cylinder into the clamping slot. This is accomplished by, in a conventional manner, initially, clamping the leading or front edge of the printing plate manually or automatically and then driving the cylinders together, as during printing, so that the printing plate is fed in in under pressure until, at the end of the infeed of the printing plate, the thrust body is situated approximately above the bent edge at the trailing or rear end of the printing plate on the plate cylinder. In this position, the thrust body of the insertion device is moved radially out of the cross-sectional contour of the blanket cylinder against the trailing or rear end of the printing plate on the plate cylinder, so that the thrust body presses the bent edge of the printing plate into the clamping slot to such a depth that the peripheral trailing or rear edge of the printing plate is also located within the cross-sectional contour of the plate cylinder and can be clamped in this position by the clamping device. Thereafter, the insertion device with the thrust body is withdrawn into a recessed position inside the gap formed in the blanket cylinder.

In accordance with another feature of the invention, the insertion device includes a pneumatic cylinder disposed in the blanket cylinder and having a piston rod with a free end, the thrust body being disposed at the free end of the piston rod.

In accordance with a further feature of the invention, the thrust body is biased by spring force in a direction towards a rest position thereof within the cross-sectional contour of the blanket cylinder. This permits the use of simplified means for actuating the insertion device and, simultaneously, ensures that the rest position does not interfere with the operation of the machine.

In accordance with an added feature of the invention, the thrust body is formed as a roller readily rotatably mounted on the piston rod of the pneumatic cylinder.

In accordance with an additional feature of the invention, the roller is elastic at least at the circumference thereof.

In accordance with yet another feature of the invention, the roller is formed of plastic material.

In accordance with yet a further feature of the invention, a helical or spiral spring is provided through which the piston rod of the pneumatic cylinder extends, the helical or spiral spring being braced, at a radially outwardly-directed end thereof, against a counterbearing disposed on the blanket cylinder and, at a radially inwardly-directed end thereof, against a counterbearing disposed on the piston rod. Thus, during the radial movement of the insertion device, the helical or spiral spring is moved out of the cross-sectional contour of the blanket cylinder and automatically pushes the insertion device back into the recessed position thereof when the pneumatic cylinder is rendered pressureless.

In accordance with yet an additional feature of the invention, both of the counterbearings have an adjustable construction, and are formed with a thread screwable into mating threads of a fastening member.

In accordance with still another feature of the invention, the counterbearings are formed as internally threaded washers.

In accordance with still a further feature of the invention, a rocker is movable articulatingly about a shaft extending parallel to the rotational axis of the blanket cylinder in the gap formed in the blanket cylinder, the roller being mounted at one end of the rocker, and a plunger is disposed adjacent the other end of the rocker and has a controllable motion for acting against the other end of the rocker.

In accordance with still an added feature of the invention, the other end of the rocker is provided with at least one stop, the stop being movable out of the contour of the blanket cylinder at an end face of the blanket cylinder, the plunger being mounted in a frame of the printing machine outside of the blanket cylinder.

In accordance with still an additional feature of the invention, drive means are included for driving the plunger.

In accordance with another feature of the invention, the drive means are a pneumatic cylinder.

In accordance with a further feature of the invention, the insertion device comprises an expansion body connected to a compressed-air source, the expansion body having a thrust surface forcible by internal pressure out of the cross-sectional contour of the blanket cylinder for exerting pressure on the trailing end of the printing plate.

In accordance with an added feature of the invention, the expansion body is formed of elastic material.

In accordance with an additional feature of the invention, the blanket cylinder and the plate cylinder are adjustable in angular positions with respect to one another.

In accordance with yet another feature of the invention, the angular positions of the blanket and plate cylinders are adjustable until the insertion device in the gap formed in the blanket cylinder overlaps the clamping slot of the clamping device in the gap formed in the plate cylinder.

In accordance with a concomitant feature of the invention, the plate cylinder is disconnectible from a drive gear therefor, and a servomotor is provided for adjusting the plate cylinder with respect to the blanket cylinder.

Although the invention is illustrated and described herein as embodied in sheet-fed offset printing machine equipped for automated changing of printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
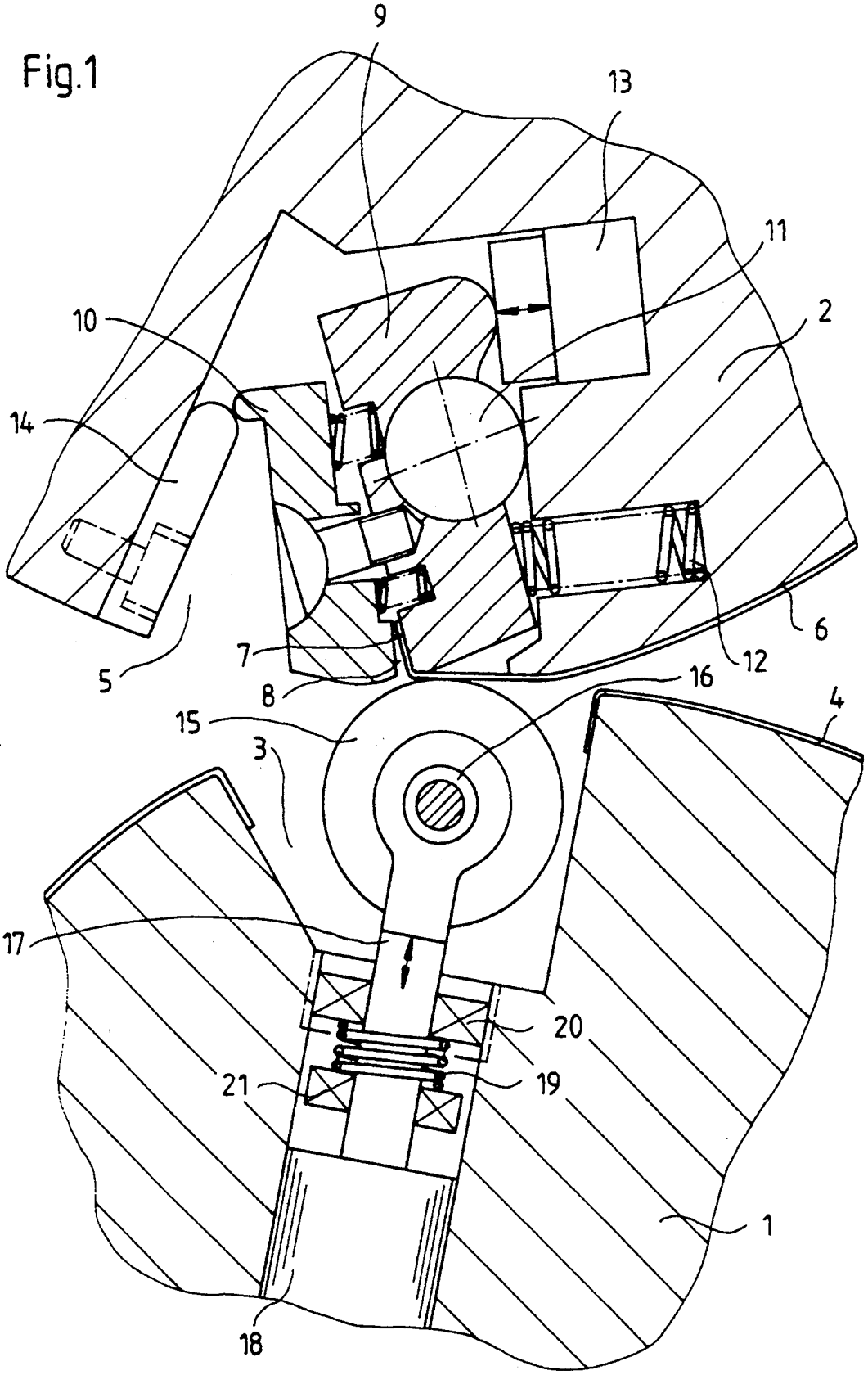
FIG. 1 is a fragmentary cross-sectional view of a blanket cylinder and a plate cylinder of a first embodiment of the sheet-fed offset printing machine according to the invention.

Referring now to the drawings and, first, particularly to FIG. 1 thereof, there is shown therein a rubber-blanket cylinder 1 and a plate cylinder 2 of a sheet-fed rotary offset printing press. The blanket cylinder 1 is formed with an axially extending gap 3, open at the circumference or outer cylindrical surface of the blanket cylinder 1, the remainder of the circumference or outer cylindrical surface being covered with a rubber blanket 4. The plate cylinder 2 is also formed with an axially extending gap 5, open at the circumference or outer cylindrical surface of the plate cylinder 2. The gap 5 formed in the plate cylinder 2 accommodates a clamping device for a printing plate 6 which is clampable onto the circumference or outer cylindrical surface of the plate cylinder 2, a leading or front edge of the printing plate 6 being fixed at a non-illustrated location on the circumference or outer cylindrical surface of the plate cylinder 2, and a trailing or rear edge of the printing plate 6 formed with a radially inwardly-directed bent edge 7 engaging in a clamping slot 8 of the clamping device. Clamping forces act upon the clamping device in the circumferential direction, thereby tautening or applying tension to the printing plate. The clamping device is made up of two clamping rails 9 and 10 which define the clamping slot 8 therebetween. A rear clamping rail 9 (as viewed in FIG. 1 in the clamping direction of the printing plate 6) is braced, in a central region thereof, by means of a shaft 11, shaft extensions or a similar spherical contour against a side wall defining the gap 5 formed in the plate cylinder 2 and thus acts as a double lever or bellcrank. An outwardly-directed end of the clamping rail 9 is continuously loaded by a pretensioned spring 12 in the clamping direction of the printing plate 6 on the circumference of the plate cylinder 2. A pneumatic unit 13 acts against an inner end of the clamping rail 9 and, upon being energized, i.e., being subjected to pneumatic pressure, the pneumatic unit 13 can cause the clamping force of the spring 12 to be overcome and the clamping device to be released. The other clamping rail 10 is connected with tension, in a central region thereof, to the clamping rail 9 and is braced by an inner end thereof against an adjustable stop 14 on an opposite wall defining the gap 5 in the plate cylinder 2, so that, when the pneumatic unit 13 is deenergized, i.e., not subjected to pneumatic pressure, the spring 12 presses the two clamping rails 9 and 10 against one another in the vicinity of the clamping slot 8 and, simultaneously, applies a loading to the the printing plate 6 on the plate cylinder 2, in the clamping direction.

An insertion device for the bent edge 7 on the trailing or rear end of the plate cylinder 2 is disposed in the base of the gap 3 formed in the blanket cylinder 1. According to the embodiment in FIG. 1, a roller made of plastic or another material having a sheathing made of plastic material forms a thrust body 15. The roller 15 is mounted in a freely rotatable manner by means of a roller bearing 16 at the end of a piston rod 17 of a pneumatic cylinder 18. The roller 15 acting as a thrust body is drivable by the pneumatic cylinder 18 radially beyond or out of the cross-sectional contour of the blanket cylinder 1 against the bent edge 7 at the trailing or rear end of the printing plate 6, as is shown in FIG. 1, for example, of the drawings. This movement occurs against the action of a spring 19, which is braced, at one end thereof, against a counterbearing 20 on the blanket cylinder 1 and, at the other end thereof, against a counterbearing 21 on the piston rod 17 of the pneumatic cylinder 18, so that when the pneumatic cylinder 18 is deenergized, i.e., not subjected to pneumatic pressure, the spring 19 withdraws the roller 15 into a rest position, recessed in the gap 3, within the cross-sectional contour of the blanket cylinder 1, and securely holds the roller 15 in the rest position. The counterbearings 20 and 21 are advantageously formed as discs and are screwable by threads formed both in the blanket cylinder 1 as well as on the piston rod 17, in order to permit adjustment of the spring tension. The outward driving movement of the roller 15 against the action of the spring 19 may alternatively also be accomplished by electrical or mechanical means. An overlapping of the gap 3 formed in the rubber-blanket cylinder 1 and of the gap 5 formed in the plate cylinder 2 is effected in a conventional manner by a phase adjustment of both cylinders 1 and 2 relative to one another.

Figure 2:
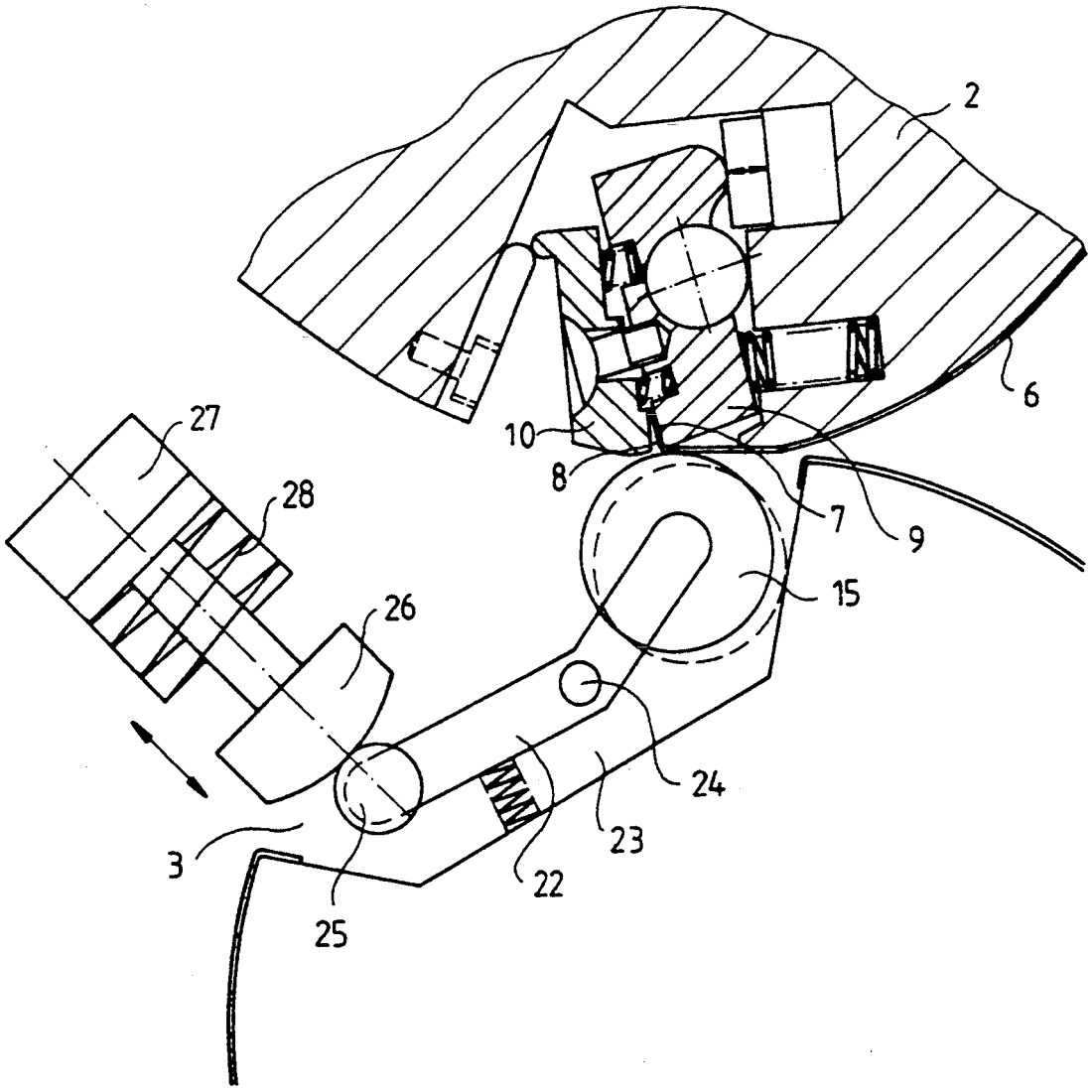
FIG. 2 is a view like that of FIG. 1, in reduced size, of a second embodiment of the invention.
Figure 3:
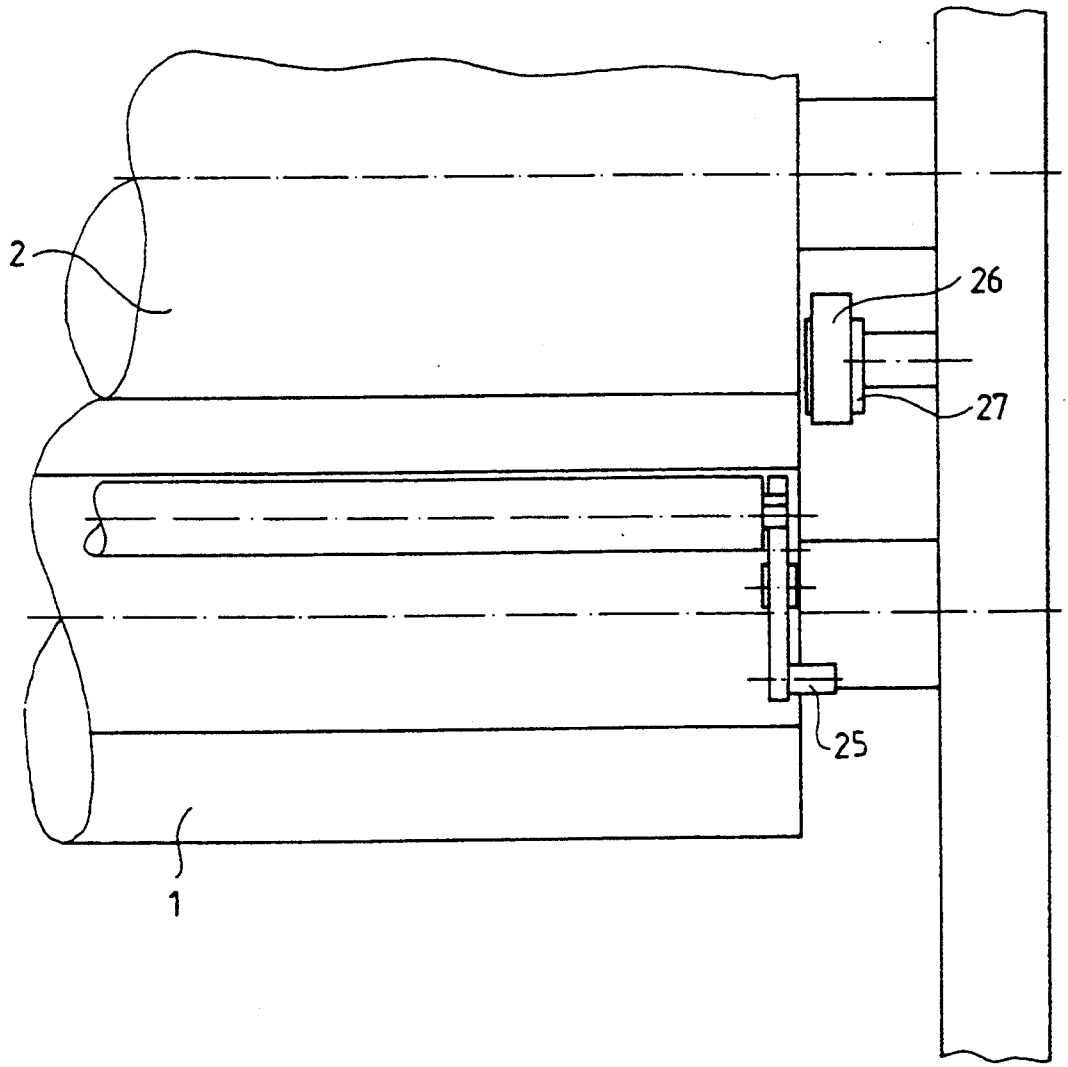
FIG. 3 is a fragmentary side elevational view of FIG. 2.

In the embodiment of the invention shown in FIGS. 2 and 3, the roller forming the thrust body 15 is rotatably mounted at one end of a rocker 22 which, in turn, is movable about a shaft 24 in a support frame 23 provided inside the gap 3 formed in the rubber-blanket cylinder 1, the shaft 24 extending parallel to the axis of rotation of the rubber-blanket cylinder 1. A plunger 26 acts against a roller 25 mounted on the other end of the rocker 22, the plunger 26 having a motorized drive and its movement being controlled in synchronism with the movements of the rubber-blanket cylinder 1 and of the plate cylinder 2 when the printing plate 6 is being clamped. The drive illustrated in FIG. 2 is formed of a pneumatic cylinder 27, which is connected to an air system of the printing machine and acts against a spring 28 which applies a load to the pneumatic cylinder 27 forcing it into the rest position thereof. A special feature becomes apparent from the side elevational view of FIG. 3, wherein the roller 25 is shown mounted outside of the rubber-blanket cylinder 1 at the end face of the rubber-blanket cylinder 1 on a rod connected to the rocker 22, so that it is possible for the plunger 26 to be disposed with the pneumatic cylinder 27 outside of the contour of the rubber-blanket cylinder 1 in the machine frame. Such an arrangement permits the insertion of the bent edge 7 of the printing plate 6 into the clamping slot 8 between the two clamping rails 9 and 10 by the roller 15 when the pneumatic cylinder 27 is energized or subjected to pneumatic pressure.

Figure 4:
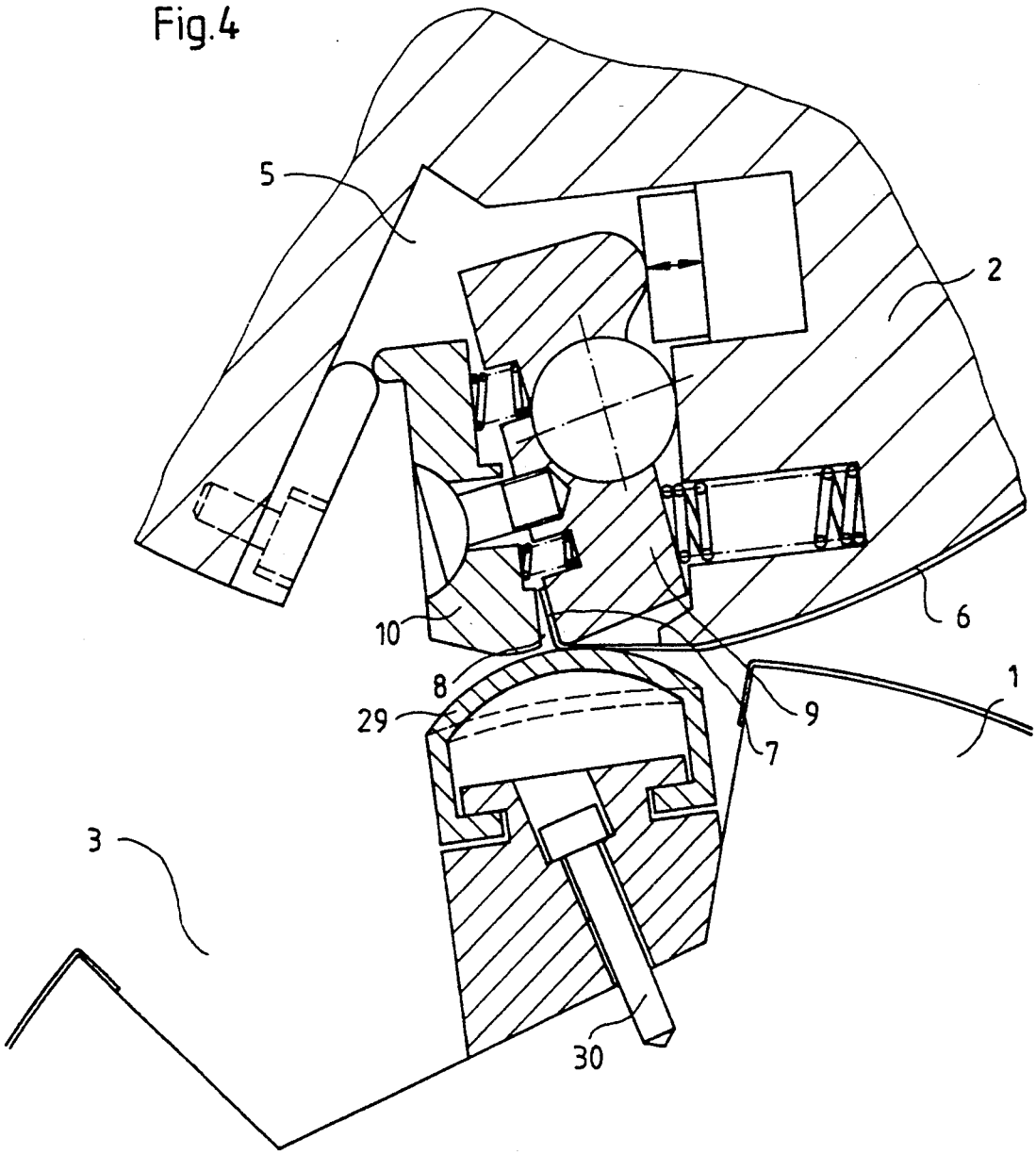
FIG. 4 is a view like that of FIG. 1 of a third embodiment of the invention.

A relatively simplified arrangement becomes apparent from the embodiment of the invention shown in FIG. 4, wherein the printing plate 6 is engageable by an expansion body 29 formed of an elastic material and having an interior space which is connectible to the air system of the printing machine through the intermediary of a line 30. Due to a buildup of internal pressure in the expansion body 29, it is possible for the printing plate 6 to be moved by a thrust surface of the expansion body 29 radially out of the contour of the rubber-blanket cylinder 1, in order to insert the bent edge 7 of the printing plate 6 into the clamping slot 8 between the two clamping rails 9 and 10. When pressureless, the expansion body 29 deflates, as represented by the broken lines, and withdraws automatically into the gap 3 formed in the rubber-blanket cylinder 1.

In order to ensure that the insertion device disposed in the gap 3 formed in the rubber-blanket cylinder 1 acts with the thrust surface of its thrust or expansion body 15, 29 against the bent edge 7 at the trailing or rear end of the printing plate 6 on the plate cylinder 2, the angular position of the rubber-blanket cylinder 1 with respect to the plate cylinder 2 may, if required, be adjustable, in order to bring the insertion device, positioned in the gap 3 of the rubber blanket cylinder 1, into overlapping relationship with the clamping slot 8 between the two clamping rails 9 and 10 of the clamping device disposed in the gap 5 of the plate cylinder 2.

One possible way of implementing or realizing the relative adjustment of the rubber-blanket cylinder 1 and the plate cylinder 2 is to make use of the coarse adjustment of the circumferential register. In this regard, the plate cylinder 2 is disconnected from a drive gear therefor and can thereby be turned 1 to 360 degrees relative to the rubber-blanket cylinder 1. It has become known heretofore to effect the disconnection manually. It is also possible, however, for the disconnection to be accomplished by pneumatic, electro-magnetic or hydraulic means. The turning of the plate cylinder 2 with respect to the non-illustrated drive gear therefor and thus with respect to the rubber-blanket cylinder 1 is performed by a conventional servomotor.

We claim:

1. Sheet-fed offset printing machine for automated changing of a printing plate having a plate cylinder for carrying a printing plate, the plate cylinder being formed with a gap extending in axial direction thereof, a blanket cylinder formed with a gap extending in axial direction thereof disposed in cooperative engagement with the plate cylinder, and a clamping device disposed in the plate-cylinder gap and including a pair of movably disposed clamping rails defining therebetween a clamping slot located within the cross-sectional contour of the blanket cylinder, and comprising an insertion device for inserting, into the clamping slot defined by the clamping rails, a bent edge of a a printing plate disposed on the plate cylinder, the bent edge being located at a trailing end of the printing plate, said insertion device being disposed in the gap formed in the blanket cylinder and having a thrust body formed with a thrust surface movable radially out of the cross-sectional contour of the blanket cylinder against the trailing end of the printing plate on the plate cylinder.

2. Insertion device for a machine according to claim 1, including a pneumatic cylinder disposed in the blanket cylinder and having a piston rod with a free end, said thrust body being disposed at said free end of said piston rod.

3. Insertion device according to claim 1, wherein said thrust body is biased by spring force in a direction towards a rest position thereof within the cross-sectional contour of the blanket cylinder.

4. Insertion device according to claim 2, wherein said thrust body is formed as a roller readily rotatably mounted on said piston rod of said pneumatic cylinder.

5. Insertion device according to claim 4, wherein said roller is elastic at least at the circumference thereof.

6. Insertion device according to claim 5, wherein said roller is formed of plastic material.

7. Insertion device according to claim 2, including a helical spring through which said piston rod of said pneumatic cylinder extends, said helical spring being braced, at a radially outwardly-directed end thereof, against a counterbearing disposed on the blanket cylinder and, at a radially inwardly-directed end thereof, against a counterbearing disposed on said piston rod.

8. Insertion device according to claim 7, wherein both of said counterbearings have an adjustable construction, and are formed with a thread screwable into mating threads of a fastening member.

9. Insertion device according to claim 8, wherein said counterbearings are formed as internally threaded washers.

10. Insertion device according to claim 4, including a rocker movable articulatingly about a shaft extending parallel to the rotational axis of the blanket cylinder in the gap formed in the blanket cylinder, said roller being mounted at one end of said rocker, and a plunger disposed adjacent the other end of said rocker having a controllable motion for acting against the other end of said rocker.

11. Insertion device according to claim 10, wherein said other end of said rocker is provided with at least one stop, said stop being movable out of the contour of the blanket cylinder at an end face of the blanket cylinder, said plunger being mounted in a frame of the printing machine outside of the blanket cylinder.

12. Insertion device according to claim 10, including drive means for driving said plunger.

13. Insertion device according to claim 12, wherein said drive means is a pneumatic cylinder.

14. Insertion device according to claim 1, comprising an expansion body connected to a compressed-air source, said expansion body having a thrust surface forcible by internal pressure out of the cross-sectional contour of the blanket cylinder for exerting pressure on the trailing end of the printing plate.

15. Insertion device according to claim 14, wherein said expansion body is formed of elastic material.

16. Sheet-fed offset printing machine according to claim 1, wherein the blanket cylinder and the plate cylinder are adjustable in angular positions with respect to one another.

17. Sheet-fed offset printing machine according to claim 16, wherein the angular positions of the blanket and plate cylinders are adjustable until said insertion device in the gap formed in the blanket cylinder overlaps the clamping slot of the clamping device in the gap formed in the plate cylinder.

18. Sheet-fed offset printing machine according to claim 16, wherein the plate cylinder is disconnectible from a drive gear therefor, and including a servomotor for adjusting the plate cylinder with respect to the blanket cylinder.

* * * * *